US008794620B2

(12) United States Patent
Wakakusa et al.

(10) Patent No.: US 8,794,620 B2
(45) Date of Patent: Aug. 5, 2014

(54) PAPER FEED CASSETTE DEVICE AND IMAGE RECORDING DEVICE WITH INTEGRALLY SLIDING TRAY PORTIONS

(75) Inventors: Keisuke Wakakusa, Nagoya (JP); Masatoshi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 153 days.

(21) Appl. No.: 12/361,536

(22) Filed: Jan. 28, 2009

(65) Prior Publication Data

US 2009/0194935 A1 Aug. 6, 2009

(30) Foreign Application Priority Data

Jan. 31, 2008 (JP) ..... 2008-021417

(51) Int. Cl.
*B65H 1/00* (2006.01)
*B65H 1/04* (2006.01)

(52) U.S. Cl.
CPC ..... *B65H 1/04* (2013.01)
USPC ..... 271/171; 271/3.14; 271/164

(58) Field of Classification Search
USPC ..... 271/3.14, 9.06, 9.11, 9.13, 164, 171; 70/78–82, 85–87; 109/45, 47, 49, 49.5, 109/50, 52, 53, 56–57; 292/194, 219, 226, 292/228, 200, 202, 210; 312/9.14, 9.15, 312/9.33–9.37, 215–221, 333, 334.44, 312/334.47
See application file for complete search history.

(56) References Cited

U.S. PATENT DOCUMENTS

| | | | | |
|---|---|---|---|---|
| 5,313,257 | A * | 5/1994 | Kashima et al. | 271/164 |
| 6,053,493 | A * | 4/2000 | Yokoyama et al. | 271/171 |
| 6,287,032 | B1 * | 9/2001 | Osmus et al. | 400/624 |
| 2002/0117796 | A1 | 8/2002 | Miyamoto | |
| 2006/0071399 | A1 | 4/2006 | Asada et al. | |
| 2007/0147940 | A1 * | 6/2007 | Hattori | 400/624 |

(Continued)

FOREIGN PATENT DOCUMENTS

| | | | |
|---|---|---|---|
| JP | SHO61-130125 | A | 6/1986 |
| JP | H07-149452 | A | 6/1995 |

(Continued)

OTHER PUBLICATIONS

Japan Patent Office, Notice of Reasons for Rejection for Japanese Patent Application No. 2009-020445 (counterpart to co-pending U.S. Appl. No. 12/697,191), mailed Nov. 24, 2010.

(Continued)

*Primary Examiner* — Gerald McClain
(74) *Attorney, Agent, or Firm* — Baker Botts L.L.P.

(57) ABSTRACT

The invention is directed to a paper feed cassette device to be removably installed to image recording device. The paper feed cassette device includes a paper feed cassette portion and a paper discharge tray portion that receives the recording media. The paper feed cassette portion has a first paper feed cassette portion and a second paper feed cassette portion that selectively contracts and extends by sliding along a particular direction. The paper discharge tray portion has a first paper discharge tray portion disposed above the first paper feed cassette portion and a second paper discharge tray portion that selectively contracts and expands by sliding along the particular direction. The second paper discharge tray portion selectively engages the second paper feed cassette portion, and the second paper feed cassette portion and the second paper discharge tray portion integrally slide with respect to the first paper discharge tray portion.

25 Claims, 8 Drawing Sheets

(56) References Cited

U.S. PATENT DOCUMENTS

| | | | | |
|---|---|---|---|---|
| 2008/0012206 | A1 | 1/2008 | Koga et al. | |
| 2008/0237977 | A1* | 10/2008 | Izuchi et al. | 271/264 |
| 2009/0085279 | A1 | 4/2009 | Wakakusa et al. | |
| 2012/0001378 | A1* | 1/2012 | Izuchi et al. | 271/264 |
| 2012/0235345 | A1* | 9/2012 | Shiota | 271/9.11 |

FOREIGN PATENT DOCUMENTS

| | | | | |
|---|---|---|---|---|
| JP | H08-026502 | A | | 1/1996 |
| JP | 11092011 | A | * | 4/1999 |
| JP | H11-092011 | A | | 4/1999 |
| JP | H11-343036 | A | | 12/1999 |
| JP | 2000-247456 | A | | 9/2000 |
| JP | 2000247456 | A | * | 9/2000 |
| JP | 2001-219621 | A | | 8/2001 |
| JP | 2002-068491 | A | | 3/2002 |
| JP | 2002068491 | A | * | 3/2002 |
| JP | 2002-114434 | A | | 4/2002 |
| JP | 2002-249233 | A | | 9/2002 |
| JP | 2003-176039 | A | | 6/2003 |
| JP | 2003176039 | A | * | 6/2003 |
| JP | 2004-331253 | A | | 11/2004 |
| JP | 2005-170626 | A | | 6/2005 |
| JP | 2006-082919 | A | | 3/2006 |
| JP | 2006-206319 | A | | 8/2006 |
| JP | 2006-341973 | A | | 12/2006 |
| JP | 2007-076751 | A | | 3/2007 |
| JP | 2007-169021 | A | | 7/2007 |
| JP | 2007-181933 | A | | 7/2007 |
| JP | 2010-006586 | A | | 1/2010 |
| JP | 2010-173832 | A | | 8/2010 |
| JP | 2010-222062 | A | | 10/2010 |
| JP | 2010-235270 | A | | 10/2010 |

OTHER PUBLICATIONS

Japan Patent Office; Notice of Reasons for Rejection in Japanese Patent Application No. 2008-021417 (counterpart to the above captioned US application) mailed May 12, 2010.

Chinese Patent Office; Office Action in Chinese Patent Application No. 200910009930.2 related to the above-captioned U.S. patent application) mailed Jan. 30, 2011 (partial translation).

U.S. Patent and Trademark Office; Office Action in U.S. Appl. No. 12/697,191 (related to the above-captioned U.S. patent application) mailed Apr. 9, 2012.

* cited by examiner

PAPER FEED CASSETTE DEVICE AND IMAGE RECORDING DEVICE WITH INTEGRALLY SLIDING TRAY PORTIONS

CROSS-REFERENCE TO RELATED APPLICATIONS

The present application claims priority to and the benefit of Japanese Patent Application No. 2008-021417, which was filed on Jan. 31, 2008, the disclosure of which is incorporated herein by reference in its entirety.

BACKGROUND OF THE INVENTION

1. Field of the Invention

The present invention relates to a paper feed cassette device integrally including a paper discharge tray, and an image recording device wherein the paper feed cassette apparatus is removably installed.

2. Description of the Related Art

In a known image recording device, e.g., a copy device and a printer device, an arrangement is made to removably install a paper feed cassette device that accommodates recording media before being subjected to recording, in an accumulated state. Image recording devices have been increasingly frequently used not only in for business use, e.g., for companies and the like, but also in homes for small-scale offices or individuals. Many types and sizes of paper, e.g., B5 to A3, L size, postcard size, regal size, and the like, may be required to be used.

However, when attempting to prepare paper feed cassette devices for each paper size, many kinds of paper feed cassette devices are needed. Also, when attempting to allow many kinds of paper feed cassette devices to be concurrently mounted on an image recording device using a known image recording device, the device may grow large. Moreover, when attempting to use many kinds of paper feed cassette devices while exchanging with one another, space for storing preliminary paper feed cassette devices may be required.

In a known image recording device, e.g., a recording device described in Japanese Unexamined Patent Application Publication No. 2007-181933, two paper feed cassette devices are provided at upper and lower stages, and a slide tray in the upper-stage paper feed cassette device is configured to be extendable/contractible. In the known image recording device, the upper and lower stage paper feed cassette devices are designed to accommodate paper of sizes different from each other, and to be able to accommodate paper of further different sizes by extending and contracting of the upper-stage paper feed cassette device.

In another known image recording device, e.g., a recording device described in Japanese Unexamined Patent Application Publication No. 2000-247456, a paper feed cassette device has a cover of an upper-stage paper feed cassette device that also serves as a paper discharge tray portion, and when paper of a large size is discharged, the mounting area of the cover is enlarged by extending an subsidiary tray of the paper discharge tray portion. Nevertheless, although a subsidiary tray is locked to a main body portion of the paper feed cassette device, an extendable/contractible movable casing is not locked thereto. Therefore, the subsidiary tray of the paper discharge tray portion may be extended even though the paper feed cassette device has not been not extended. Since the paper discharge tray portion doubles as the cover of the paper feed cassette device and is formed comparatively thin, it is low in rigidity.

Also, there are other known image recording devices in which, when the paper feed cassette device is configured to be able to feed paper of a plurality of kinds of sizes, although the paper discharge tray portion is set to a size in conformance with paper of a small size, a command for making a record onto paper of a larger size is issued without noticing the above-described state. Such a situation is prone to occur in the case wherein, for example, there are provided a plurality of paper feed cassette devices, and paper of a large size is accommodated within the lower-stage paper feed cassette device while paper of a small size is accommodated within the upper-stage paper feed cassette device.

If the mounting area of the paper discharge tray portion is smaller than the area of discharged paper, the paper may drop off from the paper discharge tray portion, and the order of discharge may be lost, thereby requiring time and effort to re-sequence the discharged paper. Moreover, in an arrangement incapable of easily performing extension/contraction, it has been necessary to perform an operation for extending the paper discharge tray portion after having once interrupted the recording command.

SUMMARY OF THE INVENTION

Accordingly, the present invention is directed to a paper feed cassette device and an image recording device for quickly performing extension/contraction of its paper discharge tray portion in accordance with the size of paper to be discharged, and for improving stability of the paper discharge tray portion, by configuring these devices so that paper of different sizes is configured to be fed thereto, and that the paper feed tray portion is extendable/contractible.

In an embodiment of the invention, a paper feed cassette device is configured to be removably installed in an image recording device, the paper feed cassette device comprising a paper feed cassette portion configured to accommodate recording media to be fed, the paper feed cassette portion comprising, a first paper feed cassette portion, and a second paper feed cassette portion configured to selectively contract and extend by sliding along a particular direction. The paper feed cassette device also comprising a paper discharge tray portion disposed above the paper feed cassette portion and configured to receive the recording media after the recording media is discharged. The paper discharge tray portion comprises a first paper discharge tray portion disposed above the first paper feed cassette portion, and a second paper discharge tray portion configured to selectively contract and expand by sliding along the particular direction, wherein the second paper discharge tray portion is configured to selectively engage the second paper feed cassette portion, and wherein the second paper feed cassette portion and the second paper discharge tray portion are configured to integrally slide with respect to the first paper discharge tray portion.

In another embodiment of the invention, an image recording device comprises a recording portion disposed inside a casing, and an accommodation portion configured to accommodate a paper feed cassette device. The paper feed device cassette comprises a paper feed cassette portion configured to accommodate recording media to be fed, and the paper feed cassette portion comprises a first paper feed cassette portion and a second paper feed cassette portion configured to selectively contract and extend by sliding along a particular direction. The paper feed cassette device also comprises a paper discharge tray portion disposed above the paper feed cassette portion and configured to receive the recording media at a mounting portion after the recording media is discharged, and the paper discharge tray portion comprises a first paper discharge tray portion disposed above the first paper feed cassette portion, and a second paper discharge tray portion configured to selectively contract and expand by sliding along the particular direction. The image recording device also comprises an opening portion disposed in one side surface of the casing, wherein the second paper discharge tray portion is configured to selectively engage the second paper feed cassette portion, and wherein the second paper feed cassette portion and the second paper discharge tray portion are configured to integrally slide with respect to the first paper discharge tray portion, and wherein the paper feed cassette device is configured to be selectively inserted into and withdrawn from the accommodation portion through the opening portion, and wherein the mounting portion of the paper discharge tray portion is configured to conform to a predetermined size of a recording medium when the second paper discharge tray portion is slid toward the outside of the paper feed device cassette.

In yet another embodiment of the invention, an image recording device comprises a recording portion disposed inside a casing, and an accommodation portion configured to accommodate a paper feed cassette device. The paper feed device cassette comprises a paper feed cassette portion configured to accommodate recording media to be fed, and the paper feed cassette portion comprises a first paper feed cassette portion and a second paper feed cassette portion configured to selectively contract and extend by sliding along a particular direction. The paper feed cassette device also comprises a paper discharge tray portion disposed above the paper feed cassette portion and configured to receive the recording media at a mounting portion after the recording media is discharged, and the paper discharge tray portion comprises a first paper discharge tray portion disposed above the first paper feed cassette portion, and a second paper discharge tray portion configured to selectively contract and expand by sliding along the particular direction. The image recording device also comprises an opening portion disposed in one side surface of the casing, wherein the second paper discharge tray portion is configured to selectively engage the second paper feed cassette portion, and wherein the second paper feed cassette portion and the second paper discharge tray portion are configured to integrally slide with respect to the first paper discharge tray portion, and wherein a lower-stage paper feed cassette device is configured to be selectively inserted into and withdrawn from the accommodation portion below the paper feed cassette device in the opening portion, and wherein the lower-stage paper feed cassette device is configured to accommodate a first size of a recording medium, and the paper feed cassette device is configured to accommodate a second size of a recording medium, and the first size is greater than or equal to the second size.

BRIEF DESCRIPTION OF THE DRAWINGS

For a more complete understanding of the invention, reference now is made to the following descriptions taken in connection with the accompanying drawings.

DETAILED DESCRIPTION OF EMBODIMENTS

Exemplary embodiments of the present invention may be understood by referring to FIGS. 1-8, like numerals being used for like corresponding parts in the various drawings.

FIGS. 1 to 7 show a printer and paper feed cassette device according to an embodiment of the invention. In an embodiment, an image recording device, a multifunction device ("MFD") 1 may have a printer function, a scanner function, a copy function, and a facsimile function. The image recording device also may be a discrete device having a single function, e.g., a scanner device, a copy device, a facsimile device, and the like.

Figure 1:
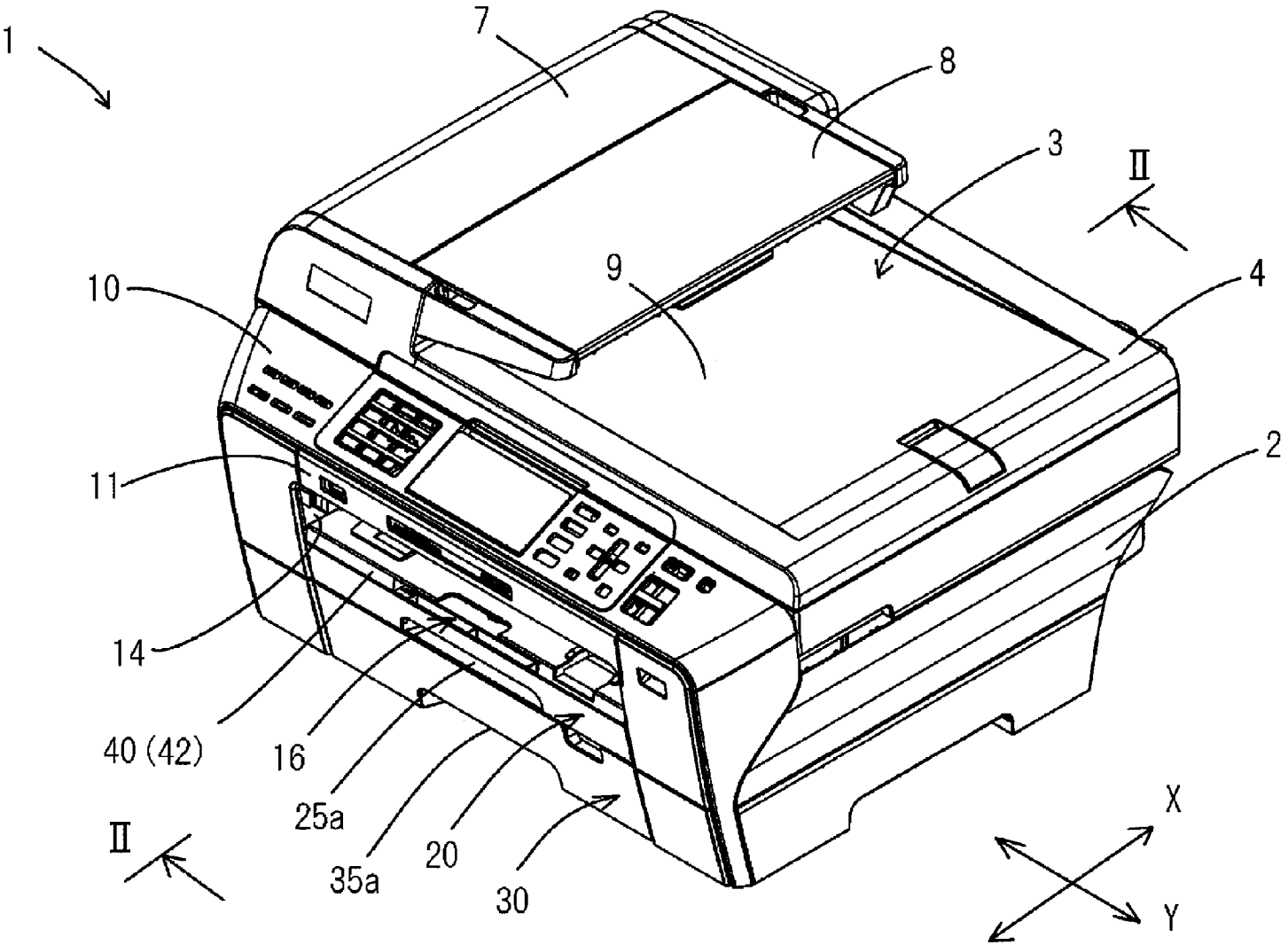
FIG. 1 is a schematic perspective view of a multifunction device according to an embodiment of the invention.

FIG. 1 shows a schematic perspective view of the multifunction device according to an embodiment. In the multifunction device 1, an upper part of a body case, e.g., a housing 2 may comprise a synthetic resin. A scanner portion, e.g., an image reading device 3, for original document reading, e.g., by the copy function or the facsimile function, may be disposed on the upper part of the body case. The image reading device 3 may read an original document and may create image data, e.g., picture data, document data, or both.

Using its copy function, the multifunction device 1 may record the data created by the image reading device 3 on a recording medium, e.g., paper, as an image, e.g., a picture, a document, and the like. Multifunction device 1 also may use its facsimile function to transmit the image data created by the image reading device 3 via a network, e.g., a telephone communication network. Furthermore, the multifunction device 1 may transmit the image data created by the image reading device 3 to a personal computer connected thereto via a cable or the like.

Figure 3:
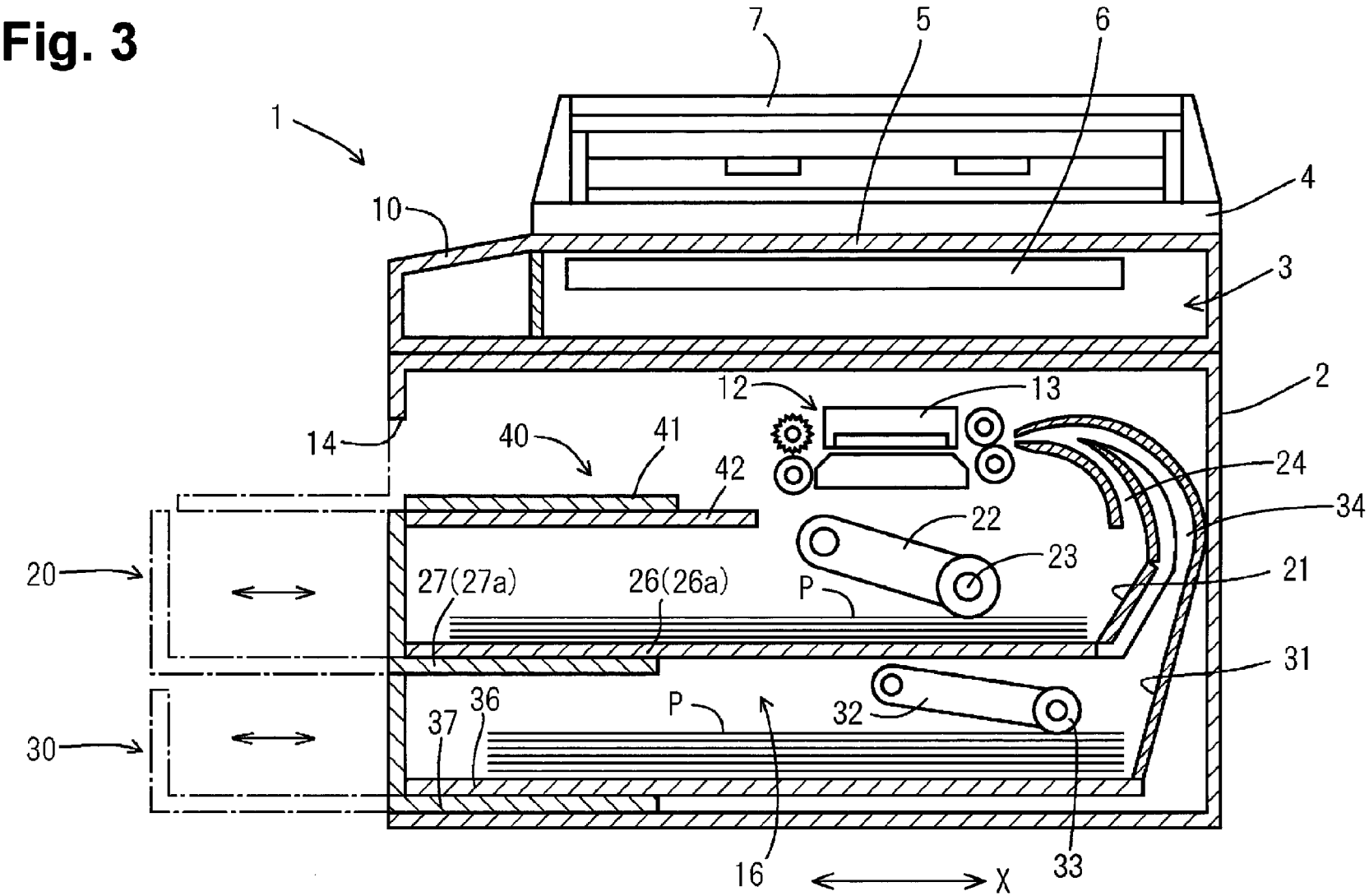
FIG. 3 is a schematic side sectional view of the multifunction device according to an embodiment of the invention.

In an embodiment, the image reading device 3 may be a flatbed scanner. Referring to FIG. 3, the multifunction device 1 may comprise an original document reading glass 5 and image sensor 6, provided below an original document cover 4 serving as a top plate, which may be opened and closed. Referring again to FIG. 1, in an embodiment of the invention, image sensor 6 may comprise a contact image sensor ("CIS") that may extend further in a direction represented by the X-axis direction of FIG. 1 than in a direction represented by the Y-axis direction of FIG. 1. In another embodiment of the invention, image sensor 6 may comprise a charge coupled device ("CCD"). An original document to be subjected to image reading may be placed on the original document reading glass 5, and the image sensor 6 may perform image reading by reciprocating along the Y-axis direction of FIG. 1, below the original document reading glass 5.

The original document cover 4 may comprise an automatic original document conveying mechanism, e.g., auto document feeder ("ADF") 7. The ADF 7 may convey original documents placed on an original document tray 8, which is shown in its closed state in FIG. 1. Original documents may be fed, one after another, onto the original document reading glass 5, and image sensor 6 may remain stationary below the original document reading glass 5, while reading original documents fed onto the original document reading glass 5. The original documents that have been read may be discharged to an original document discharge tray 9.

Multifunction device 1 may comprise a control panel 10 disposed in an upper portion in the front multifunction device 1. Control panel 10 may be equipped with control buttons or a liquid crystal display portion which may be operated to command various operations. A slot portion 11 may be disposed below the control panel 10, and may be loadable with various compact memory cards serving as recording media.

Figure 2:
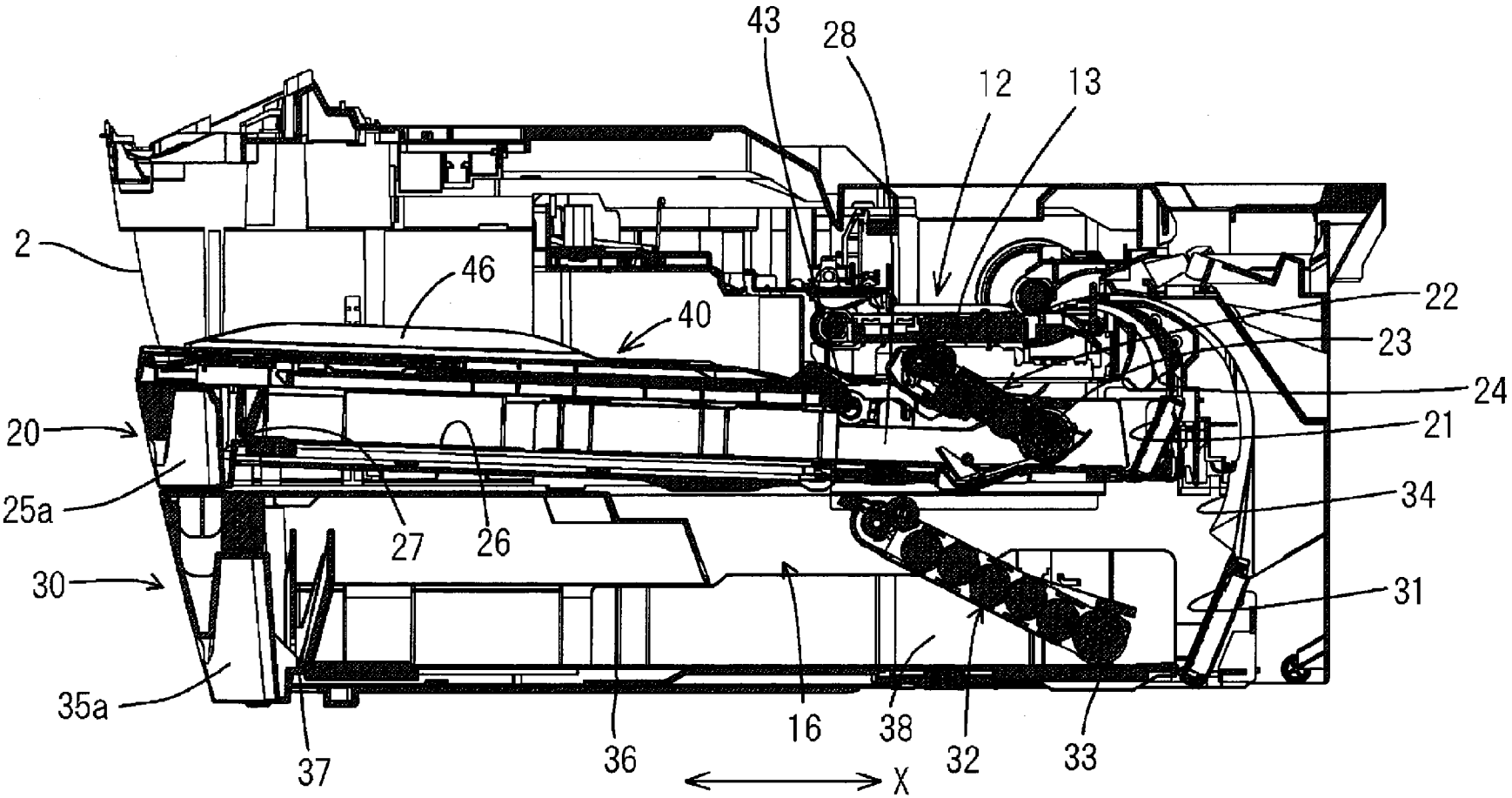
FIG. 2 is a sectional view taken away along the II-II line in FIG. 1.

FIGS. 2 and 3 show the internal structure of the multifunction device 1 according to an embodiment of the invention. As shown, a recording portion 12 may be arranged in a central portion of the body case 2. The recording portion 12 may comprise inkjet-type recording heads 13. An ink cartridge (not shown), which may be accommodated inside the body case 2, may supply color inks to recording heads 13, Flexible ink supply tubes may deliver different color inks independently of each other.

Figure 4:
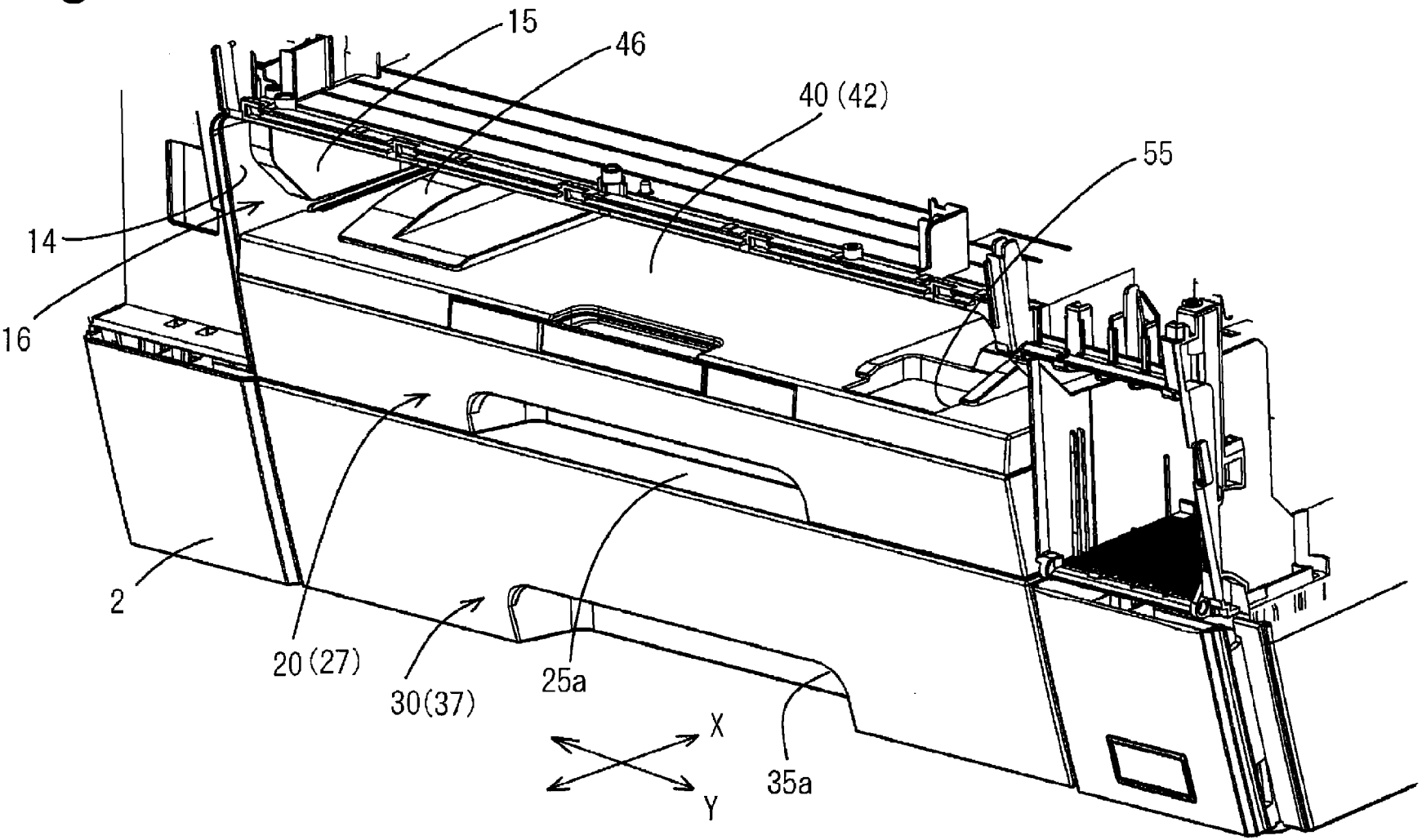
FIG. 4 is an enlarged view of the area around an opening portion of the multifunction device.

As shown in FIGS. 1 and 4, a lower portion in the front of the multifunction device 1, may have an opening portion 14, and a paper feed cassette device, e.g., upper-stage paper feed cassette device 20, and a lower-stage paper feed cassette device 30, each may be arranged in the opening portion 14. Upper-stage paper feed cassette device 20, and a lower-stage paper feed cassette device 30 each may be arranged to be removably inserted substantially along a horizontal direction, with respect to an accommodation portion 16, disposed in the bottom of the body case 2, through the opening portion 14. Hereinafter, the side in which the opening portion 14 in the body case 2 is located is referred to as the front, or the front side. The back side, opposite the front side, and the right and left of the device also may be defined using the above-described front as a reference. Also, as described above, the back-to-front direction of the multifunction device 1 is aligned along the X-axis direction, and the right-to-left direction thereof is aligned along the Y-axis direction.

As shown in FIG. 4, rail-shaped guide portions may be disposed on right and left inner side surfaces of the opening portion 14, for inserting the upper-stage and lower-stage paper feed cassette devices 20 and 30 into respective positions. The guide portions 15 each may be disposed at a position which may abut against the top surface of a paper discharge tray portion 40, which will be described in more detail herein.

The upper-stage and lower-stage paper feed cassette devices 20 and 30 each may be configured to accumulate and accommodate a large number of recording media, e.g., paper sheets. The upper-stage and lower-stage paper feed cassette devices 20 and 30 each may be removably inserted into and withdrawn from the multifunction device 1, in the substantially same direction as a feed direction of the accommodated paper sheets. The depth side of the upper-stage and lower-stage paper feed cassette devices 20 and 30 in the insertion and withdrawal direction may constitute a downstream side of the feed direction of the paper sheets.

An upper-stage separation tilt plate 21 may be disposed on the depth side of the upper-stage paper feed cassette device 20, e.g., the right side as shown in FIGS. 2 and 3. Also, an upper-stage paper feed roller 23 may be pivotally supported on a front end of an upper-stage paper feed arm 22, and may be disposed at a position opposite to a position on the depth side of the bottom surface of the upper-stage paper feed cassette device 20. The upper-stage paper feed arm 22 may be urged resiliently in the downward direction, and the upper-stage paper feed roller 23 may abut against the uppermost top surface of paper sheets that may be accumulated and accommodated within the upper-stage paper feed cassette device 20. A driving source (not shown) may transmit a driving force to the upper-stage paper feed roller 23 to rotate it, and upper-stage paper feed roller 23 may separate one sheet of the paper P after another at the uppermost layer, by a cooperative operation between the upper-stage paper feed roller 23 and the upper-stage separation tilt plate 21. After separation, the paper P may be guided in an upward direction.

The upper-stage paper conveying path 24 may be formed into a U-turn shape that curves toward the front side of the multifunction device 1, after having moved in an upward direction away from the upper-stage separation tilt plate 21. The paper P may be discharged to the paper discharge tray portion 40 after the recording portion 12 records the image on the paper P. The upper-stage paper feed arm 22 may perform an ascending and a descending operation following an inserting and a withdrawing operation, respectively, of the upper-stage paper feed cassette device 20, which may allow upper-stage paper feed roller 23 to avoid colliding against the upper-stage separation tilt plate 21.

The lower-stage paper feed cassette device 30 also is formed substantially in the same manner as the upper-stage paper feed cassette device 20. A lower-stage separation tilt plate 31 may be disposed on the depth side, e.g., the right side as shown in FIGS. 2 and 3 of the lower-stage paper feed cassette device 30. Also, a lower-stage paper feed roller 33 may be pivotally supported on a front end of a lower-stage paper feed arm 32, and may be disposed at a position opposite to a position on the depth side of the bottom surface of the lower-stage paper feed cassette device 30. The lower-stage paper feed arm 32 may be urged resiliently in the downward direction, and the lower-stage paper feed roller 33 may abut against the uppermost top surface of paper sheets that may be accumulated and accommodated within the lower-stage paper feed cassette device 30. A driving source (not shown) may transmit a driving force to the lower-stage paper feed roller 33 to rotate it, and lower-stage paper feed roller 33 may separate one sheet of the paper P after another at the uppermost layer, by a cooperative operation between the lower-stage paper feed roller 33 and the lower-stage separation tilt plate 31. After separation, the paper P may be guided in an upward direction.

The lower-stage paper conveying path 34 may be disposed further toward an outer wall of casing 2 than the upper-stage paper conveying path 24, and may be formed into a U-turn shape, e.g., an arcuate shape, which may be larger than the shape formed by the upper-stage paper conveying path 24. The U-turn shape of lower-stage paper conveying path 34 may curve to the front side of the multifunction device 1 after having moved in an upward direction from the lower-stage separation tilt plate 31. Recording portion 12 may record an image on the paper that has been conveyed via the lower-stage paper conveying path 34, the paper with the recorded image then may be discharged to the paper discharge tray portion 40. The lower-stage paper feed arm 32 may perform an ascending and a descending operation following an inserting and a withdrawing operation, respectively, of the upper-stage paper feed cassette device 20, which may allow lower-stage paper feed roller 33 to avoid colliding against the lower-stage separation tilt plate 31.

The upper-stage paper feed cassette device 20 may be disposed at a position at which the above-described paper discharge tray portion 40 may overlap a portion of the paper feed cassette portion, e.g., the upper-stage paper feed cassette portion 25. Paper sheets fed from the upper-stage paper feed cassette device 20 and paper sheets fed from the lower-stage paper feed cassette device 30 may be discharged to the paper discharge tray portion 40. The paper sheets may be accumulated in paper discharge tray portion 40 in the order of discharging.

The upper-stage paper feed cassette portion 25 in the upper-stage paper feed cassette device 20 may have a substantially boxy shape, of which the top surface may be substantially opened. The paper discharge tray portion 40 also may act as a substantially dustproof cover for paper accommodated within the upper-stage paper feed cassette portion 25, and may have a substantially thin planar shape. Therefore, the paper discharge tray portion 40 may be configured to cover, in a lid shape, at least a portion of an upper opening of the upper-stage paper feed cassette portion 25, except for a portion which may interfere with the upper end paper feed arm 22, e.g., at least a portion near the opening portion 14.

As shown in FIG. 3, the upper-stage paper feed cassette portion 25 may comprise a first paper feed cassette portion 26 located on its depth side, e.g., the right side as shown in FIGS. 2 and 3, in the insertion and withdrawal direction, e.g., in the X-axis direction, and a second paper feed cassette portion 27 that may be installed such that second paper feed cassette portion may be extendable and contractible by sliding along the insertion and withdrawal direction with respect to the first paper feed cassette portion 26. Specifically, as shown in FIG. 3, the second paper feed cassette portion 27 may be installed at a position at which its paper mounting plate 27*a* overlaps below at least a portion of a paper mounting plate 26*a* of the first paper feed cassette portion 26. A grip portion 25*a* may be disposed on a side surface on the front side, e.g., the front surface of the second paper feed cassette portion 27.

As described in more detail herein, the second paper feed cassette portion 27 may be configured to be installed such that the second paper feed cassette portion may be configured to be held at a plurality of, e.g., three, stages, e.g., three states, e.g., three locking states. The three stages, e.g., states may correspond to: 1) a position where second paper feed cassette portion 27 may be contracted with respect to the first paper feed cassette portion 26; 2) a position where second paper feed cassette portion 27 may be extended with respect to the first paper feed cassette portion 26; and 3) an intermediate position between the first and the second positions. When the second paper feed cassette portion 27 is slid to a position at which second paper feed cassette portion 27 is fully extended in the X-axis direction, the paper of A3 size may be accommodated, e.g., configured such that that the longitudinal direction of the paper of A3 size may be accommodated along the X-axis direction. When the second paper feed cassette portion 27 is slid to a position at which second paper feed cassette portion 27 is fully contracted, the paper of A4 size may be accommodated, e.g., configured such that the longitudinal direction of the paper of A4 size may be accommodated along the Y-axis direction.

The upper-stage paper feed cassette portion 25 may comprise a pair of side guides 28, which may be configured to guide side edges along the X-axis direction of the paper, and upper-stage paper feed cassette portion discretionarily may perform a width adjustment of the distance between the side guides 28 in the Y-axis direction by the known operative association mechanism. By adjusting the distance between the side guides 28, the paper to be accommodated may be subjected to a centering operation with respect to the upper-stage paper feed cassette portion 25. The adjustment by the side guides 28 and the adjustment by the extension or contraction of the second paper feed cassette portion 27 may allow paper from the L size up to the A3 size to be accommodated within the upper-stage paper feed cassette portion 25.

Regarding lower-stage paper feed cassette device 30, the lower-stage paper feed cassette portion 35 also may be configured to serve as a paper accommodation portion, and may comprise a lower-stage first paper feed cassette portion 36 disposed on its depth side, e.g., the right side as shown in FIGS. 2 and 3, in the insertion and withdrawal direction, e.g., in the X-axis direction, and a lower-stage second paper feed cassette portion 37 that may be installed such that second paper feed cassette portion may be extendable and contractible by sliding along the insertion and withdrawal direction with respect to the lower-stage first paper feed cassette portion 36.

The lower-stage second paper feed cassette portion 37 may be installed such that lower-stage second paper feed cassette portion 37 may move between two stages. The first stage may correspond to a position at which lower-stage second paper feed cassette portion 37 may be contracted with respect to the lower-stage first paper feed cassette portion 36, and the second stage may correspond to a position at which lower-stage second paper feed cassette portion 37 position may be extended with respect to the lower-stage first paper feed cassette portion 36.

In an embodiment, lower-stage paper feed cassette portion 35 may comprise side guides 38, shown in more detail in FIG. 2. As in the case of the upper-stage paper feed cassette portion 25, the lower-stage paper feed cassette portion 35 also discretionarily may perform a width adjustment of the distance between the side guides 38 in the Y-axis direction, which may cause the paper to be accommodated to be the subject of a centering operation with respect to the lower-stage paper feed cassette portion 35. A grip portion 35*a* may be disposed on a side surface on the front side, e.g., the front surface, of the second paper feed cassette portion 27.

Figure 5A:
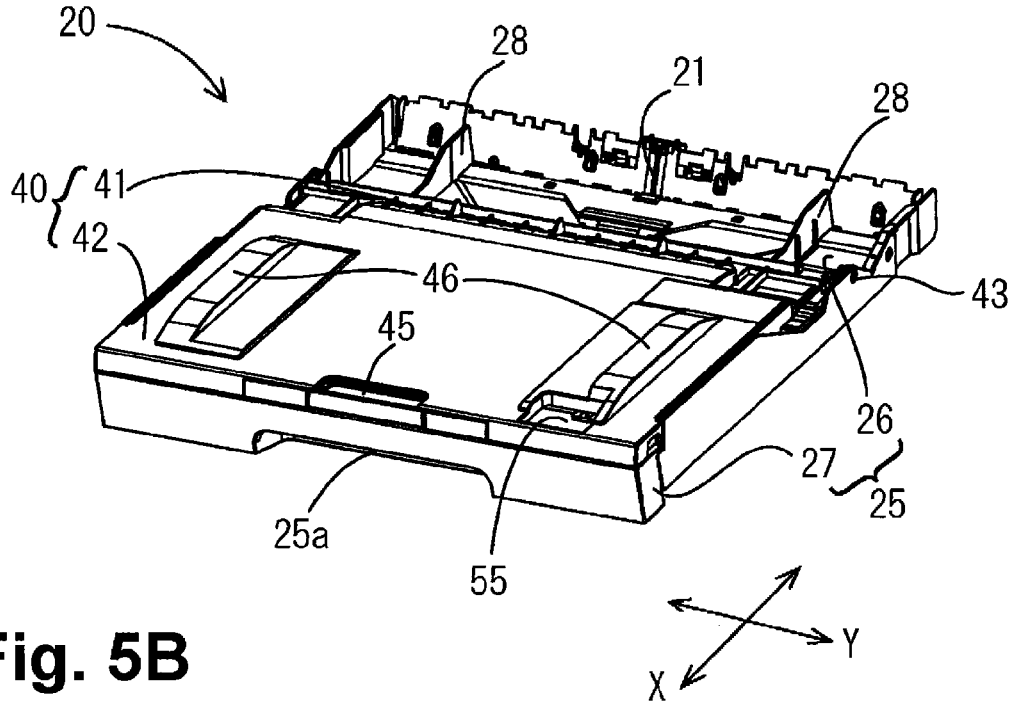
FIG. 5A is a perspective view of an upper-stage paper feed cassette device in its contracted state, according to an embodiment of the invention.
Figure 5B:
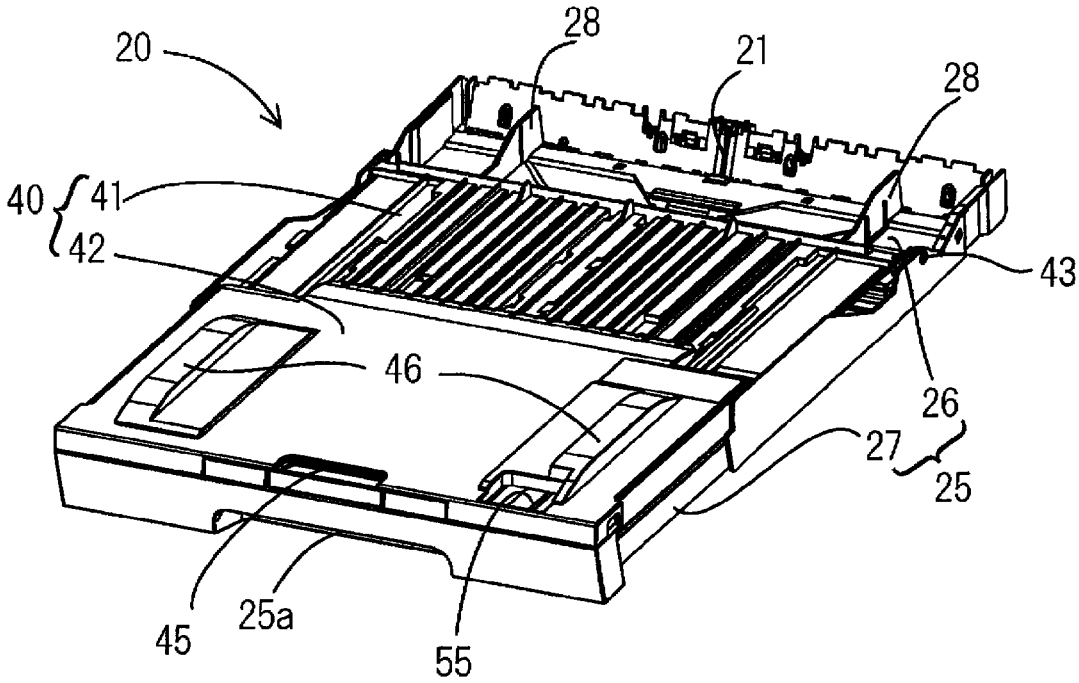
FIG. 5B is a perspective view of the upper-stage paper feed cassette device in its extended state, according to an embodiment of the invention.

The paper discharge tray portion 40 may comprise a first paper discharge tray portion 41 which may overlap a portion of the first paper feed cassette portion 26 in the upper-stage paper feed cassette device 20, and a second paper discharge tray portion 42 which may be installed such that the second paper discharge tray portion 42 may be extendable and contractible by being slid along the insertion and withdrawal direction, respectively, with respect to the first paper feed cassette portion 41. As shown in FIGS. 5A and 5B, the paper discharge tray portion 40 may be installed such that the first paper discharge tray portion 41 may overlap below at least a portion of the second paper discharge tray portion 42. A grip portion 45 may be disposed at a position on the front side of the second paper discharge tray portion 42. A pair of ribs 46 may be disposed on the top surface of the second paper discharge tray portion 42. Ribs 46 may be arranged on the right and left sides of the top surface of the second paper discharge tray portion 42, and ribs 46 may protrude and extend along the X-axis direction. Ribs 46 may prevent, resist, or inhibit the paper from dropping off by inclining upward the end on the front side of the paper to be mounted.

The paper discharge tray portion 40 may be configured to pivotally support the upper-stage paper feed cassette portion 25 by a hinge portion 43 disposed on the depth side of the paper discharge tray portion 40. The front side, e.g., the side near the opening portion 14, the paper discharge tray portion 40, may turn upward about the depth side, e.g., the far side of the opening portion 14. This configuration may allow a user to perform an operation for setting the paper within the upper-stage paper feed cassette portion 25 by grasping the grip portion 45 of the paper discharge tray portion 40 and lifting up the paper discharge tray portion 40. As described in more detail herein, the turning of the paper discharge tray portion 40 may be operated in a state wherein the upper-stage paper feed cassette device 20 has been removed from the multifunction device 1.

Figure 6A:
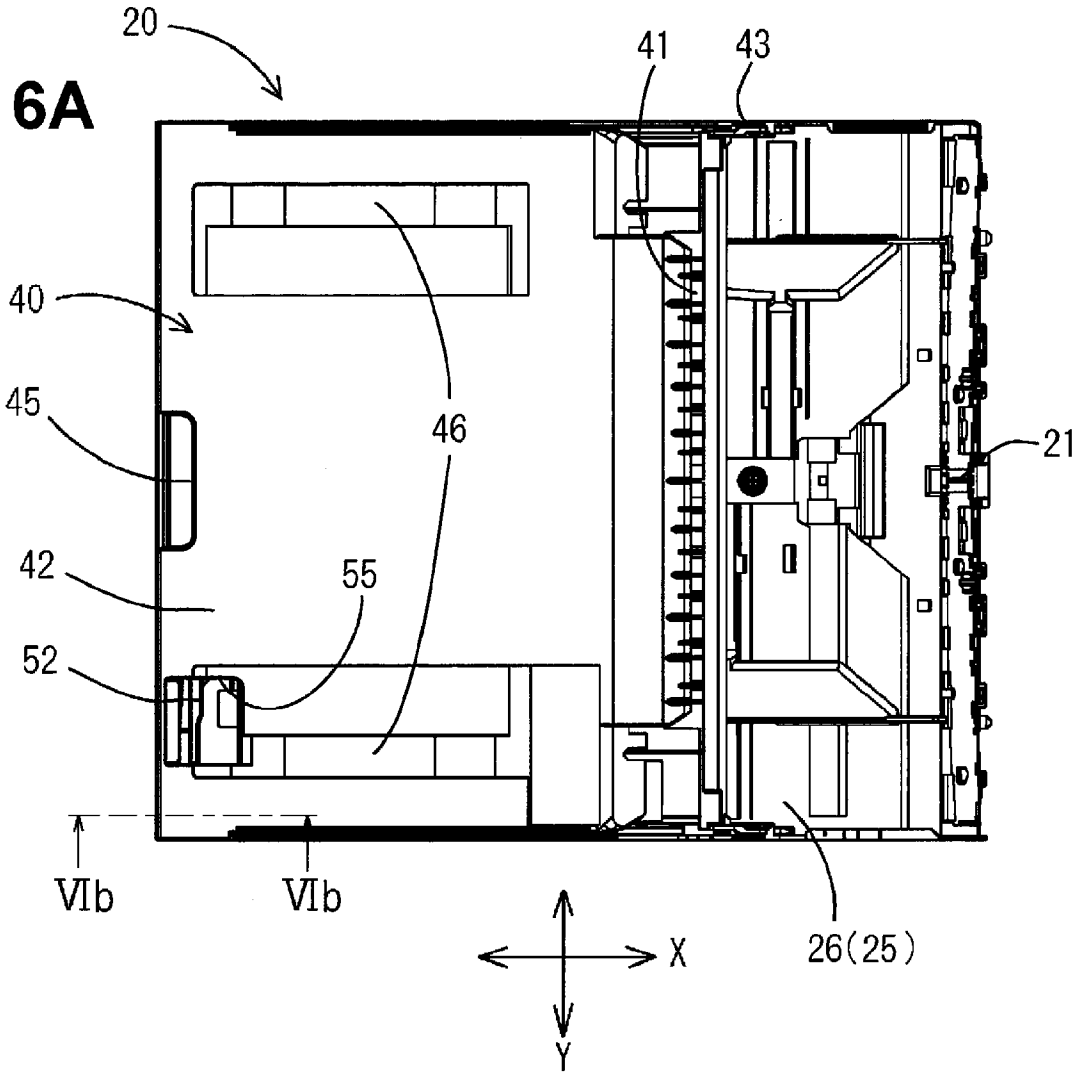
FIG. 6A is a plan view of the upper-stage paper feed cassette device in its contracted state, according to an embodiment of the invention.
Figure 6B:
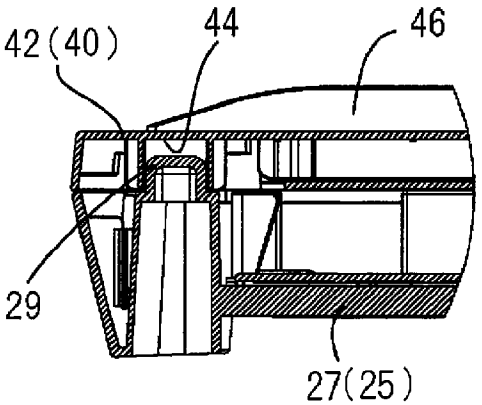
FIG. 6B is a sectional view taken along the line VIa-VIb in FIG. 6A.

As shown in FIGS. 6A and 6B, engagement recesses 44 may be formed at both the right and left ends on the front side of the second paper discharge tray portion 42 in the paper discharge tray portion 40. Engagement recesses 44 may open downward. Moreover, boss portions 29 may be formed at both the right and left ends on the front side of the second paper feed cassette portion 27 in the upper-stage paper feed cassette portion 25. Boss portions 29 may as protrude upward in order to provide concave-convex fitting with the engagement recesses 44. When the boss portions 29 and the engagement recesses 44 are concavo-convex interlocked, the second paper discharge tray portion 42 and the second paper feed cassette portion 27 may be integrally extended and contracted. That is, the sliding of the second paper discharge tray portion 42 and that of the second paper feed cassette portion 27 may be integrally performed in operative association with each other.

Referring to FIG. 4, the guide portions 15 provided in the opening portion 14 of the multifunction device 1 may abut against both ends on the right and left on the top surface of the second paper discharge tray portion 42 in the paper discharge tray portion 40. Therefore, when the second paper discharge tray portion 42 and the second paper feed cassette portion 27 are in a first state wherein they have slid and extended in an integral manner, wobbling thereof in a vertical direction may be inhibited, resisted, or constrained by the guide portions 15. Also, in a state of having been inserted into the opening portion 14, the upper-stage paper feed cassette device 20 may not open the second paper discharge tray portion 42 about the hinge portion 43, and hence, when setting the paper; setting operation may be performed with the opening portion 14 withdrawn from the opening portion 14.

Figure 7A:
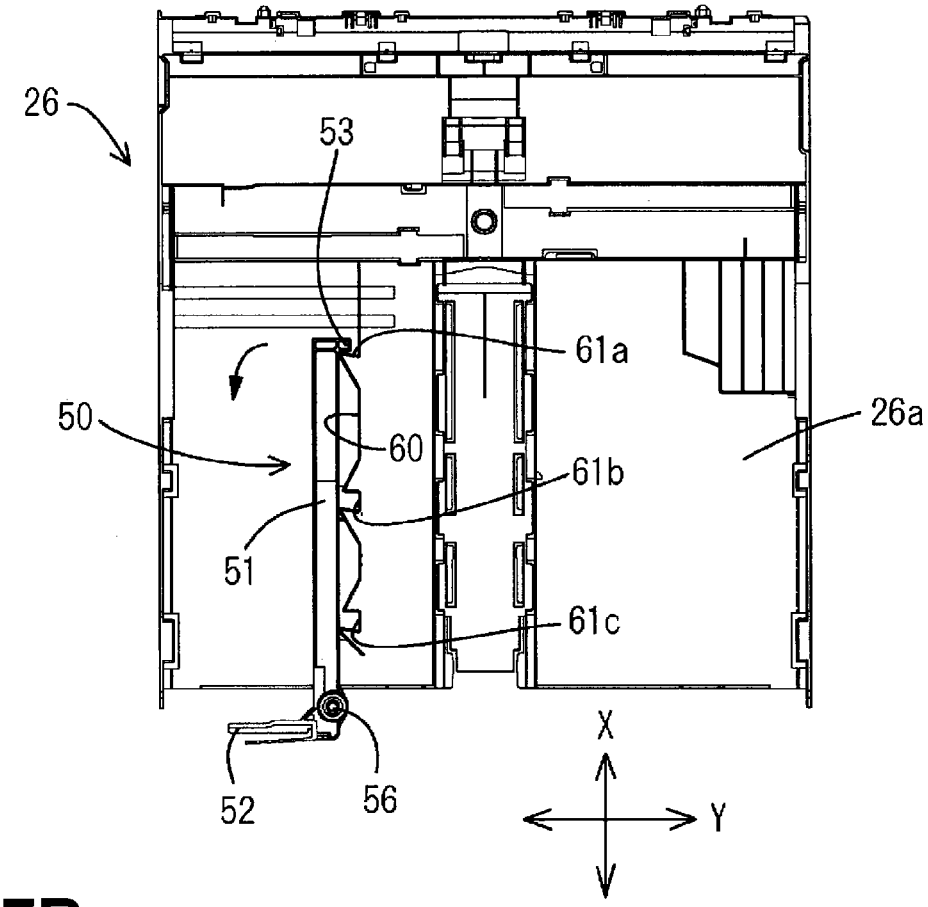
FIG. 7A is a bottom plan view of a first paper feed cassette portion, according to an embodiment of the invention.
Figure 7B:
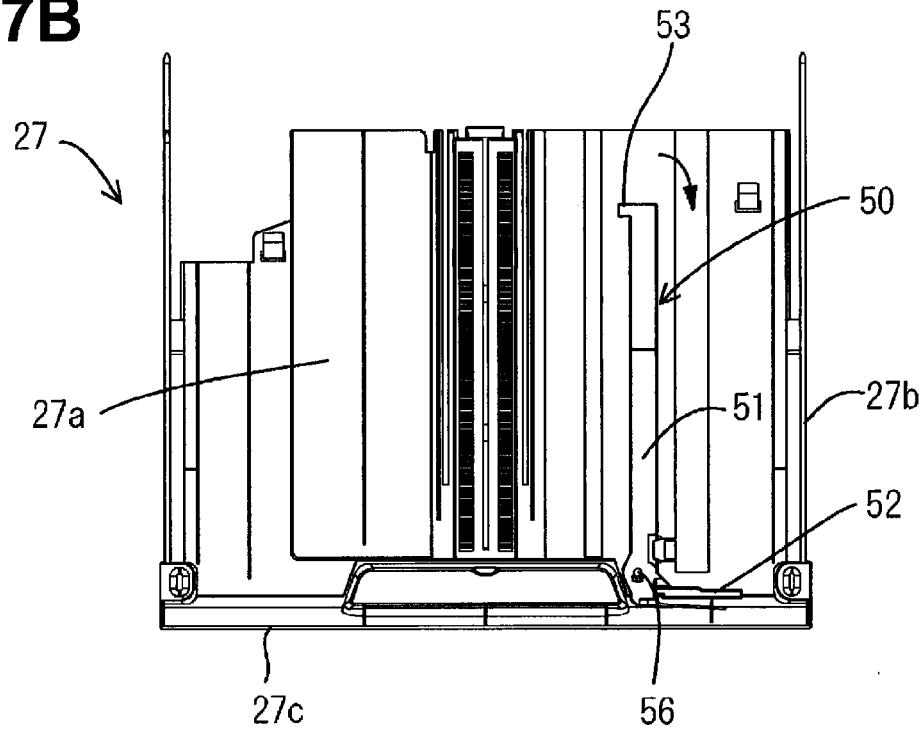
FIG. 7B is a top plan view of a second paper feed cassette portion, according to an embodiment of the invention.

The upper-stage paper feed cassette portion 25 may comprise locking portion 50 which may be configured to hold an extension and contraction position of the second paper feed cassette portion 27, with respect to the first paper feed cassette portion 26, or for allowing sliding of the second paper feed cassette portion 27. As shown in FIGS. 7A and 7B, locking portion 50 may be disposed to hold the position of the second paper feed cassette portion 27, which may prevent the second paper feed cassette portion 27 from being inadvertently extended/contracted.

Locking portion 50 may comprise a locking bar 51 extending in the X-direction. Locking bar 51 may be disposed at a position near one side surface 27*b*, e.g., the right side as shown in FIG. 1, of the second paper feed cassette portion 27, on the top surface of the paper mounting plate 27*a* in the second paper feed cassette portion 27. The locking bar 51 is pivotally supported on the paper mounting plate 27*a*, and is disposed to protrude at a position near the front surface 27*c* of the second paper feed cassette portion 27, e.g., a position on the front side thereof in the insertion and withdrawal direction, such that the locking bar 51 may swing in the horizontal direction about a rotational shaft 56.

In an embodiment of the invention, an operation portion 52 of the locking bar 51 may be formed, and may be bent into an L-shape, and may extend from the position of the rotational shaft 56 in the Y-axis direction, along the front surface 27*c*. The front end on the depth side of the locking bar 51 may be bent into an L-shape with respect to a center line of the paper mounting plate 27*a*, and may comprise a protruding portion 53 which may be configured to engage the first paper feed cassette portion 26.

A guide rail 60 extending in the X-axis direction may be installed integrally with locking bar 51, on the bottom surface side of the paper mounting plate 26*a* of the first paper feed cassette portion 26. Engagement receiving portions, which are configured to selectively engage with the protruding portion 53, may be formed at three places in the guide rail 60, shown in FIG. 7A as engagement receiving portions 61*a* to 61*c*, along the X-axis direction. The engagement receiving portions 61*a* to 61*c* each may be formed into a concave shape that may open in a sideward direction, such that the protruding portion 53 may be locked to one of the engagement receiving portions thereto.

In an embodiment of the invention, in a first state, the protruding portion 53 of the locking bar 51 may be locked to the engagement receiving portion 61*a*. In this state, second paper feed cassette portion 27 may be in a fully contracted state with respect to the first paper feed cassette portion 26. In this state, the upper-stage paper feed cassette portion 25 may be configured for use in mounting the paper of A4 size thereon, with its longitudinal direction along the Y-axis direction, or for use in mounting the paper of a size smaller than the A4 size thereon.

In an embodiment of the invention, in a second state, the protruding portion 53 of the locking bar 51 may be locked to the engagement receiving portion 61*c*. In this state, second paper feed cassette portion 27 may be in a fully extended state with respect to the first paper feed cassette portion 26. In this state, the upper-stage paper feed cassette portion 25 may be configured for use in mounting the paper of A3 size thereon, with its longitudinal direction being along the X-axis direction.

In an embodiment of the invention, in a third state, the protruding portion 53 of the locking bar 51 may be locked to the engagement receiving portion 61*b*. In this state, the second paper feed cassette portion 27 may be extended to a substantially midway position. In this state, the upper-stage paper feed cassette portion 25 is suitable for use in mounting thereon the paper of A4 size, with its longitudinal direction being along the X-axis direction.

Moreover, in an embodiment of the invention, in an unlocked state, the protruding portion 53 of the locking bar 51 may be locked to none of the engagement receiving portions 61*a* to 61*c*. In this state, the second paper feed cassette portion 27 may slide. Inclined surfaces that incline in right and left directions in a plan view may be disposed between the engagement receiving portions in the guide rail 60. These inclined surfaces may be configured to provide smoothly performing engagements and disengagements between locking bar 51 and engagement receiving portions 61*a* to 61*c*.

In an embodiment, the extension and contraction position of the second paper feed cassette portion 27 with respect to the first paper feed cassette portion 26 may be configured to be changeable among three stages. Nevertheless, the extension and contraction positions are not limited to three stages. For example, in another embodiment, the extension and contraction position may be changed between two stages, . . . , a first stage in which the second paper feed cassette portion 27 may be fully extended, and second stage in which the second paper feed cassette portion 27 may be fully contracted. Alternatively, the extension and contraction positions may be changed in more than three stages.

As shown in FIG. 6A, in the second paper discharge tray portion 42, a penetrating portion 55 may have an opening area large enough to allow the insertion of a finger of the user formed therethrough. The opening area may be disposed on the right side on the front side of the plate surface, and may expose the operation portion 52 of the locking bar 51 to the outside. Here, the penetrating portion 55 and the operation portion 52 may be disposed toward the right side of the multifunction device 1. This configuration may be more convenient for a right-handed user.

In an embodiment, when the user inserts his/her finger into the penetrating portion 55, the user may touch the operation portion 52 of the locking bar 51 disposed below the penetrating portion 55. When the user pulls the operation portion 52 toward the user's side by the finger that has been inserted into the operation portion 52, the locking bar 51 may swing in the horizontal direction, about the rotational shaft 56, e.g., in a clockwise direction when viewed in a plan view, thereby allowing the protruding portion 53 to disengage from one of the engagement receiving portions, . . . , engagement receiving portions 61*a*, 61*b*, or 61*c*.

In the first state, e.g., the state in which the protruding portion 53 of the locking bar 51 may be locked to the engagement receiving portion 61*a*, the user may insert an index finger into the penetrating portion 55 and may pull the operation portion 52 toward the user's side, with the thumb placed on the front surface side of the second paper feed cassette portion 27, or the second paper discharge tray portion 42. The user then may pull the second paper discharge tray portion 42 toward the user's side, e.g., outside of the opening portion 14. Thereupon, due to the concave-convex fitting between the engagement recesses 44 and the boss portions 29, the second paper feed cassette portion 27 and the second paper discharge tray portion 42 integrally may operate, may be pulled out toward the front side in the withdrawal direction. Then, the user freely may move the second paper feed cassette portion 27 in a back-and-forth direction in an unlocked state, and may lock it in the second state, e.g., engagement receiving portion 61*c*, or in the third state, e.g., engagement receiving portion 61*b*.

Similarly, to execute sliding operations of the second paper feed cassette portion 27 and the second paper discharge tray portion 42, the user may grasp their respective grip portions 25*a* and 45 to operate the respective portions. The penetrating portion 55 may be disposed on the front side of the second paper discharge tray portion 42, which may allow the user to ascertain a remaining amount of the paper accommodated within the upper-stage paper feed cassette device 20, via the penetrating portion 55.

In an embodiment, paper of A3 size may be accommodated within the lower-stage paper feed cassette device 30, and paper of A4 size may be accommodated with its longitudinal direction being along the X-axis direction. That is, the upper-stage paper feed cassette device 20 may be in the first state wherein the protruding portion 53 of the locking bar 51 may be engaged with the engagement receiving portion 61*a* of the guide rail 60. In the upper-stage paper feed cassette device 20, the second paper feed cassette portion 27 may be fully contracted with respect to the first paper feed cassette portion 26, and the second paper discharge tray portion 42 also may be fully contracted with respect to the first paper discharge tray portion 41. When the paper having A4 size is fed, to perform recording upon specifying the upper-stage paper feed cassette device 20, even if the paper is discharged upon the paper discharge tray portion 40, the paper may be mounted within the paper discharge tray portion 40 without the paper dropping off therefrom.

Nevertheless, the paper of A3 size may be fed to perform recording upon specifying the upper-stage paper feed cassette device 20, e.g., if a user has forgotten that the paper discharge tray portion 40 has not been extended to a size corresponding to the A3 size. In such a case, as described above, in an embodiment, the insertion of a finger of the user into the penetrating portion 55 may allow the user to touch the operation portion 52 of the locking portion 50. Therefore, the user may pull out the second paper discharge tray portion 42 integrally with the second paper feed cassette portion 27 while pulling the operation portion 52 toward the user's side. This operation may enlarge the mounting area of the second paper discharge tray portion 42, which thereby may allow prevention of the discharged paper from dropping off.

The second paper discharge tray portion 42 may extend integrally with the second paper feed cassette portion 27, and may be prohibited from singly extending. This may provide rigidity of the second paper discharge tray portion 42, and may enable the discharged paper to be stably mounted thereon.

The paper discharge tray portion 40 also may be configured to serve as a lid for protecting the paper accommodated within the upper-stage paper feed cassette portion 25 against dust. As a consequence, if the operation portion 52 is covered in a scaled manner, with the paper discharge tray portion 40 not equipped with the penetrating portion, the user may be prevented from touching the operation portion 52, even if the operation portion 52 of the locking portion 50 is disposed within the upper-stage paper feed cassette portion 25. In order for a user to touch operation portion 52, the user may extract the entire upper-stage paper feed cassette device 20 from the multifunction device 1 to open the paper discharge tray portion 40. However, as in the above-described embodiment, disposing the penetrating portion 55 for exposing the operation portion 52 in the second paper discharge tray portion 42 may enable operation of the locking portion 50 even with the upper-stage paper feed cassette device 20 inserted in the multifunction device 1. As a result, as described above, the paper discharge tray portion 40 quickly may be extended or contracted after a recording operation has been started.

Figure 8:
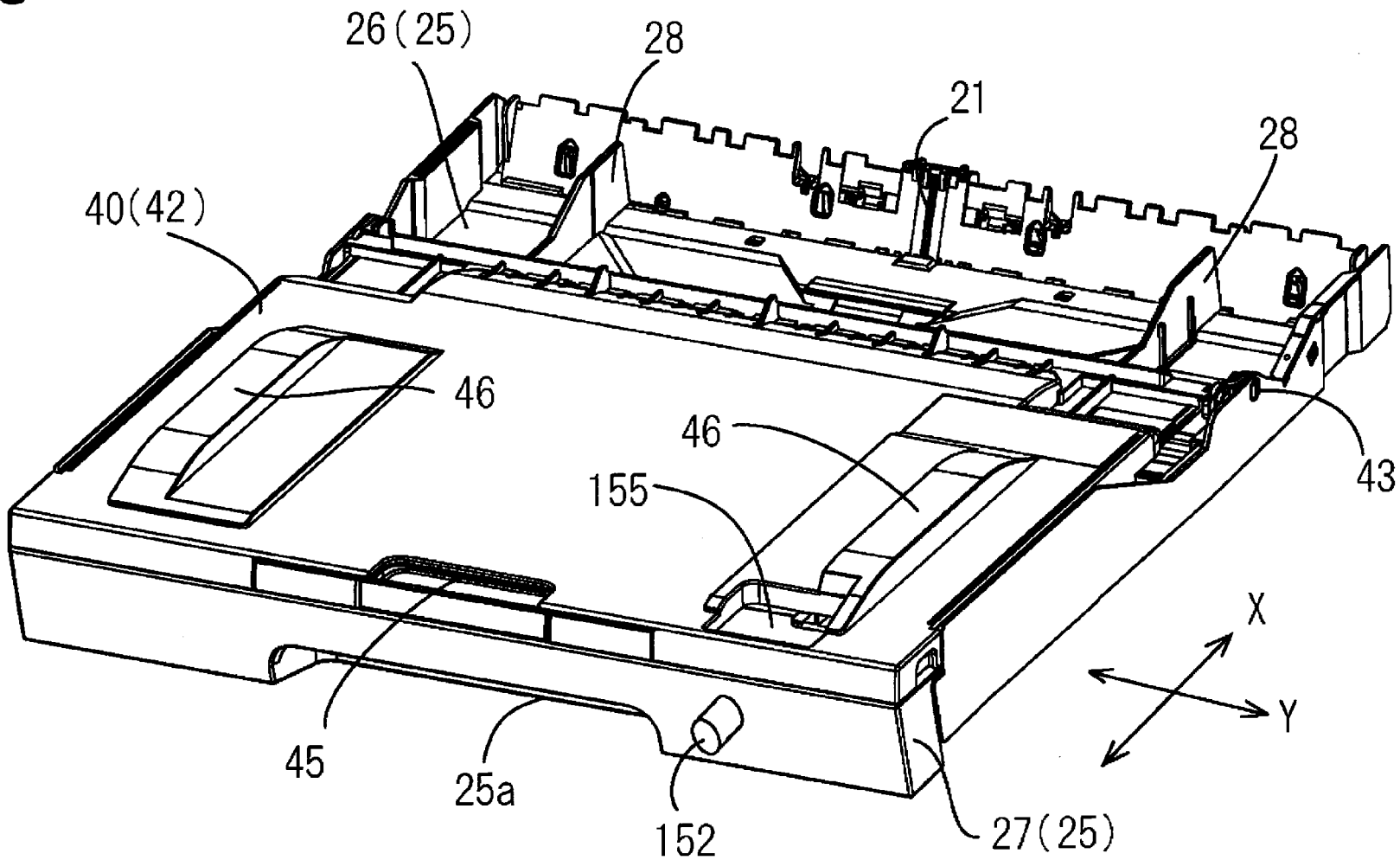
FIG. 8 is a perspective view showing an operation portion of locking portion according to another embodiment of the invention.

FIG. 8 shows another embodiment of an operation portion. In this embodiment, an arrangement may be configured such that the user may touch an operation portion 152 of the locking portion 50 while bypassing the intermediary of the penetrating portion. In this embodiment, operation portion 152 may penetrate a side plate on the front side of the second paper feed cassette portion 27, and operation portion 152 may be installed on the outer surface, e.g., the front surface. In this embodiment, the user should be careful not to inadvertently contact the locking portion 50, thereby unlocking it. Nevertheless, in the arrangement disclosed in this embodiment, the user may more easily operate the operation portion 152 of the locking portion 50. In this embodiment, at a position near the operation portion 152 of the second paper discharge tray portion 42, a penetrating portion 155 may be disposed for the purposes of a user placing finger thereon and thereby ascertaining the remaining amount of the paper. The penetrating portion 155 may have a size sufficient for a user to insert a finger into the penetrating portion. The penetrating portion 155 may be formed by perforating a wall of the second paper feed cassette portion 27.

For example, when the user puts an index finger on a penetrating portion 155 while pushing the operation portion 152 with a thumb, it may be possible to integrally slide the second paper discharge tray portion 42 and the second paper feed cassette portion 27 while releasing the locking portion 50. Instead of the penetrating portion 155, a concave-shaped grip portion, which may be configured to receive a user's finger thereon, may be installed. In this case, the dust resistance of the upper-stage paper feed cassette portion 25 may be enhanced.

In an embodiment of the invention, the upper-stage and lower-stage paper feed cassette devices 20 and 30 may be removably inserted into and withdrawn from the opening portion 14 of the multifunction device 1. Nevertheless, another embodiment of the invention may be arranged such that a paper feed cassette device having a similar configuration to the upper-stage paper feed cassette device 20 may be removably inserted into and withdrawn from the opening portion 14, and a paper feed cassette device having a similar configuration to the lower-stage paper feed cassette device 30 may not be removably inserted into and withdrawn from the opening portion 14. In this embodiment, the mounting area when the paper discharge tray portion 40 has been extended may be configured to conform to a maximum size of paper which may be accommodated within the paper feed cassette device. As described above, when the second paper feed cassette portion 27 of the paper feed cassette device, e.g., the upper-stage paper feed cassette device 20, is extended for accommodation of the paper of a large size, the second paper discharge tray portion 42 also may extend integrally therewith, which may prevent the user from forgetting to enlarge the mounting area of the paper discharge tray portion 40.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A paper feed cassette device configured to be removably installed in an image recording device, the paper feed cassette device comprising:

a base portion comprising:

a first paper feed cassette portion comprising a first placement surface on which recording media is to be placed; and a first paper discharge tray portion comprising a first discharge surface on which discharged recording media is to be placed, the first paper discharge tray portion being disposed above the first paper feed cassette portion; and an extendable portion configured to both contract and extend with respect to the base portion, the extendable portion comprising:

a second paper feed cassette portion comprising a second placement surface on which recording media is to be placed when the extendable portion is extended with respect to the base portion by sliding the second paper feed cassette portion along a particular direction; and a second paper discharge tray portion comprising a second discharge surface on which discharged recording media is to be placed, the second paper discharge tray portion being disposed above the second paper feed cassette portion and being configured to both extend and contract together with the second paper feed cassette portion when the second paper feed cassette portion is extended and contracted with respect to the base portion, wherein the base portion and the extendable portion are configured such that:

each of the first placement surface, the second placement surface, the first discharge surface, and the second discharge surface faces upward, and when the extendable portion is extended and contracted with respect to the base portion, the second placement surface of the second paper feed cassette portion slides below the first placement surface of the first paper feed cassette portion and the second discharge surface of the second paper discharge tray portion simultaneously slides above the first discharge surface of the first paper discharge tray portion.

2. The paper feed cassette device according to claim 1, wherein the first paper discharge tray portion further comprises a hinge and is configured to be pivotally supported by the hinge, with respect to the first paper feed cassette portion.

3. The paper feed cassette device according to claim 1, wherein the paper discharge tray portion is configured to cover an upstream portion of the paper feed cassette portion.

4. The paper feed cassette device according to claim 1, wherein at least one of the second paper discharge tray portion and the second paper feed cassette portion comprises a grip portion configured to facilitate the sliding operation.

5. The paper feed cassette device according to claim 1, further comprising a locking portion configured to transition between a first state, a second state, and an unlocked state, wherein when the locking portion is in the first state, the second paper feed cassette portion is configured to be in a contracted state with respect to the first paper feed cassette portion, when the locking portion is in the second state, the second paper feed cassette portion is configured to be in an extended state with respect to the first paper feed cassette portion, and when the locking portion is in the unlocked state, the second paper feed cassette portion is configured to slide freely.

6. The paper feed cassette device according to claim 5, wherein when the locking portion is in the first state, the second paper feed cassette portion is configured to be in a fully contracted state, and wherein when the locking portion is in the second state, the second paper feed cassette portion is configured to be in a fully extended state.

7. The paper feed cassette device according to claim 5, wherein the locking portion extends in the particular direction, and the locking portion comprises a locking bar having a first end and a second end opposite the first end, and the locking portion is configured to be pivotally supported about a rotational shaft of the second paper feed cassette portion, wherein the locking bar comprises:

an operation portion having a substantially L-shape and extending in a further direction away from the rotational shaft at the first end, wherein the further direction is perpendicular to the particular direction;

a protruding portion having a substantially L-shape at the second end and extending in a direction opposite the further direction.

8. The paper feed cassette device according to claim 7, wherein the first paper feed cassette portion comprises at least one engagement receiving portion disposed on the bottom surface of the first paper feed cassette portion, and wherein the protruding portion is configured to selectively engage one of the at least one engagement receiving portion.

9. The paper feed cassette device according to claim 8, wherein when the operation portion is pulled toward the front in the particular direction, the locking bar is configured to swing in a horizontal direction about the rotational shaft, and the protruding portion is configured to disengage from the one of the at least one engagement receiving portion, thereby transitioning the locking portion to the unlocked state.

10. The paper feed cassette device according to claim 8, wherein the at least one engagement receiving portion is disposed along the first paper feed cassette portion in the particular direction, and wherein a number of the at least one engagement receiving portion corresponds to a number of states in which the second paper feed cassette portion is configured to be locked.

11. The paper feed cassette device according to claim 5, wherein:

the operation portion is disposed inside the base portion and on the front side of the base portion in the particular direction, the operation portion extends outward to an exterior of the second paper discharge tray portion through a penetrating portion formed through the second paper discharge tray portion, and the penetrating portion has a predetermined diameter configured to allow access to the second paper discharge tray portion.

12. The paper feed cassette device according to claim 11, wherein the penetrating portion is formed by perforating at least a portion of a wall of the second paper discharge tray portion.

13. The paper feed cassette device according to claim 11, wherein:

at least one of the second paper discharge tray portion and the second paper feed cassette portion comprises a grip portion configured to facilitate the sliding operation, the operation portion is disposed on an outer surface of a side plate on the front side of the base portion in the particular direction, and at least one of the grip portion and the penetrating portion is configured to have a predetermined diameter, and is disposed substantially adjacent to the operation portion of the second paper discharge tray portion.

14. The paper feed cassette device according to claim 11, wherein the penetrating portion is disposed in a position configured to allow visual access to the recording media accommodated within the base portion.

15. The paper feed cassette device according to claim 1, wherein the second paper discharge tray portion is configured to selectively engage with the second paper feed cassette portion using a concave-to-convex fitting.

16. The paper feed cassette device according to claim 1, wherein when the extendable portion is contracted with respect to the base portion, the second placement surface of the second paper feed cassette portion is positioned below the first placement surface of the first paper feed cassette portion.

17. The paper feed cassette device according to claim 1, wherein when the extendable portion is contracted with respect to the base portion, the second discharge surface of the second paper discharge tray portion is positioned above the first discharge surface of the first paper discharge tray portion.

18. The paper feed cassette device according to claim 17, wherein the second paper discharge tray portion comprises a protrusion protruding upward from the second discharge surface of the second paper discharge tray portion.

19. The paper feed cassette device according to claim 1, wherein:

the second paper feed cassette portion of the extendable portion comprises an engaging portion;

the second paper discharge tray portion of the extendable portion comprises an engaged portion; and the engaging portion of the second paper feed cassette portion and the engaged portion of the second paper discharge tray portion are configured to engage each other to restrict relative movement between the second paper feed cassette portion and the second paper discharge tray portion.

20. The paper feed cassette device according to claim 19, wherein:

the second paper discharge tray portion is configured to open with respect to the second paper feed cassette portion; and the engaging portion of the second paper feed cassette portion and the engaged portion of the second paper discharge tray portion are configured to disengage each other when the second paper discharge tray portion is opened with respect to the second paper feed cassette portion.

21. An image recording device comprising:

a recording portion disposed inside a casing;

an accommodation portion configured to accommodate a paper feed cassette device, the paper feed cassette device comprising:

a base portion comprising:

a first paper feed cassette portion comprising a first placement surface on which recording media is to be placed; and a first paper discharge tray portion comprising a first discharge surface on which discharged recording media is to be placed, the first paper discharge tray portion being disposed above the first paper feed cassette portion; and an extendable portion configured to both contract and extend with respect to the base portion, the extendable portion comprising:

a second paper feed cassette portion comprising a second placement surface on which recording media is to be placed when the extendable portion is extended with respect to the base portion by sliding the second paper feed cassette portion along a particular direction; and a second paper discharge tray portion comprising a second discharge surface on which discharged recording media is to be placed, the second paper discharge tray portion being disposed above the second paper feed cassette portion and being configured to both extend and contract together with the second paper feed cassette portion when the second paper feed cassette portion is extended and contracted with respect to the base portion; and an opening portion disposed in one side surface of the casing, wherein the paper feed cassette device is configured to be selectively inserted into and withdrawn from the accommodation portion through the opening portion, wherein the second discharge surface is configured to conform to a predetermined size of a recording medium when the second paper discharge tray portion is slid toward the outside of the paper feed device cassette, and wherein the base portion and the extendable portion are configured such that:

each of the first placement surface, the second placement surface, the first discharge surface, and the second discharge surface faces upward, and when the extendable portion is extended and contracted with respect to the base portion, the second placement surface of the second paper feed cassette portion slides below the first placement surface of the first paper feed cassette portion and the second discharge surface of the second paper discharge tray portion simultaneously slides above the first discharge surface of the first paper discharge tray portion.

22. The image recording device according to claim 21, wherein when the paper feed cassette device is inserted into the accommodation portion, the second paper discharge tray portion is configured to engage the second paper feed cassette portion and to resist a disengagement of the second paper feed cassette portion.

23. An image recording device comprising:

a recording portion disposed inside a casing;

an accommodation portion configured to accommodate a paper feed cassette device, the paper feed cassette device comprising:

a base portion comprising:

a first paper feed cassette portion comprising a first placement surface on which recording media is to be placed; and a first paper discharge tray portion comprising a first discharge surface on which discharged recording media is to be placed, the first paper discharge tray portion being disposed above the first paper feed cassette portion; and an extendable portion configured to both contract and extend with respect to the base portion, the extendable portion comprising:

a second paper feed cassette portion comprising a second placement surface on which recording media is to be placed when the extendable portion is extended with respect to the base portion by sliding the second paper feed cassette portion along a particular direction; and a second paper discharge tray portion comprising a second discharge surface on which discharged recording media is to be placed, the second paper discharge tray portion being disposed above the second paper feed cassette portion and being configured to both extend and contract together with the second paper feed cassette portion when the second paper feed cassette portion is extended and contracted with respect to the base portion;

an opening portion disposed in one side surface of the casing; and a lower-stage paper feed cassette device configured to be selectively inserted into and withdrawn from the accommodation portion below the paper feed cassette device in the opening portion, wherein the lower-stage paper feed cassette device is configured to accommodate a first size of a recording medium, wherein the paper feed cassette device is configured to accommodate a second size of a recording medium, wherein the first size is greater than or equal to the second size, and wherein the base portion and the extendable portion are configured such that:

each of the first placement surface, the second placement surface, the first discharge surface, and the second discharge surface faces upward, and when the extendable portion is extended and contracted with respect to the base portion, the second placement surface of the second paper feed cassette portion slides below the first placement surface of the first paper feed cassette portion and the second discharge surface of the second paper discharge tray portion simultaneously slides above the first discharge surface of the first paper discharge tray portion.

24. The image recording device according to claim 23, wherein the first size of the recording medium is equal to the second size of the recording medium when the second paper discharge tray portion is slid to an outside position.

25. The image recording device according to claim 23, wherein when the paper feed cassette device is inserted into the accommodation portion, the second paper discharge tray portion is configured to engage the second paper feed cassette portion and to resist a disengagement of the second paper feed cassette portion.

* * * * *